US011326288B2

(12) United States Patent
Chen

(10) Patent No.: US 11,326,288 B2
(45) Date of Patent: May 10, 2022

(54) INDEPENDENT PRESSER FOOT DRIVE MECHANISM AND EMBROIDERY MACHINE

(71) Applicant: ZHEJIANG HEHE ELECTRIC MACHINERY CO., LTD, Zhejiang (CN)

(72) Inventor: Zhengan Chen, Zhejiang (CN)

(73) Assignee: ZHEJIANG HEHE ELECTRIC MACHINERY CO., LTD, Shaoxing (CN)

( * ) Notice: Subject to any disclaimer, the term of this patent is extended or adjusted under 35 U.S.C. 154(b) by 31 days.

(21) Appl. No.: 16/916,079

(22) Filed: Jun. 29, 2020

(65) Prior Publication Data

US 2021/0087731 A1 Mar. 25, 2021

(30) Foreign Application Priority Data

Sep. 25, 2019 (CN) ..... 201921597512.5
Jan. 19, 2020 (CN) ..... 202010061700.7

(51) Int. Cl.
*D05C 9/20* (2006.01)
*D05C 11/06* (2006.01)

(52) U.S. Cl.
CPC ..... *D05C 9/20* (2013.01); *D05C 11/06* (2013.01)

(58) Field of Classification Search
CPC ..... D05C 9/20; D05C 11/06; D05B 29/02; D05B 55/14
USPC ..... 112/98, 220, 221, 235–239
See application file for complete search history.

(56) References Cited

U.S. PATENT DOCUMENTS 4,006,696 A * 2/1977 Robertson ..... D05B 11/00 112/117
4,716,846 A * 1/1988 Schneider ..... D05B 29/00 112/239
5,331,909 A * 7/1994 Tajima ..... D05B 29/02 112/103
5,373,795 A * 12/1994 Kato ..... D05B 29/02 112/236
5,590,614 A * 1/1997 Murata ..... D05B 29/02 112/237
5,615,628 A * 4/1997 Tajima ..... D05B 29/02 112/157

(Continued)

FOREIGN PATENT DOCUMENTS

EP 2182102 A1 * 5/2010 ..... D05B 47/04
KR 20070110804 A * 11/2007 ..... D05B 29/02

*Primary Examiner* — Danny Worrell

(57) ABSTRACT

An independent presser foot drive mechanism and an embroidery machine includes a machine head, a needle bar drive mechanism mounted on the machine head, a needle bar drive block provided on a corresponding guide rod and movable up and down. The presser foot drive block further includes a presser foot drive motor that independently drives a presser foot, and a presser foot link assembly that connects the presser foot drive motor with the presser foot drive block to complete driving of the presser foot. The presser foot can be independently driven to move by providing the independent presser foot drive motor and the presser foot link assembly. According to corresponding embroidery processes, the presser foot can independently complete more complicated actions under the driving of the drive motor.

17 Claims, 7 Drawing Sheets

(56) References Cited

U.S. PATENT DOCUMENTS

| | | | | |
|---|---|---|---|---|
| 5,927,221 | A * | 7/1999 | Porter | D05B 69/28 112/470.07 |
| 6,170,414 | B1 * | 1/2001 | Kaetterhenry | D05B 11/00 112/102.5 |
| 7,654,209 | B2 * | 2/2010 | Park | D05B 29/02 112/220 |
| 10,174,449 | B2 * | 1/2019 | Koike | D05B 29/02 |
| 2007/0261621 | A1 * | 11/2007 | Suzuki | D05B 55/16 112/220 |
| 2008/0196646 | A1 * | 8/2008 | Makino | D05B 55/14 112/470.01 |
| 2008/0216720 | A1 * | 9/2008 | Park | D05B 29/12 112/98 |
| 2009/0249990 | A1 * | 10/2009 | Park | D05B 29/02 112/284 |
| 2021/0087731 | A1 * | 3/2021 | Chen | D05C 9/20 |

* cited by examiner

INDEPENDENT PRESSER FOOT DRIVE MECHANISM AND EMBROIDERY MACHINE

CROSS REFERENCE TO RELATED APPLICATIONS

The present application claims the benefit of Chinese Patent Application Nos. 201921597512.5 filed on Sep. 25, 2019 and 202010061700.7 filed on Jan. 19, 2020. All the above are hereby incorporated by reference.

TECHNICAL FIELD

The present disclosure relates to an independent presser foot drive mechanism and an embroidery machine using the mechanism.

BACKGROUND TECHNOLOGY

A presser foot and a needle bar of the existing embroidery machine are driven by corresponding cams provided on a main shaft. Due to the increasing number of machine heads, it easily causes insufficient power of the main shaft, vibration, or other problems. Furthermore, since the presser foot and the needle bar operate at the same time, the presser foot is controlled by the driving of the machine so that it cannot complete more complicated processing.

When an embroidery machine is operating, the main shaft of the embroidery machine is continuously running. The continuously running main shaft drives corresponding needle bars on all the machine heads of the embroidery machine to run continuously through needle bar driving devices such that even some of the machine heads that are not being used will run together. This increases the load on the main shaft and wastes resources.

In order to reduce the load, a jump motor will be provided on the machine head. The jump motor is provided with a corresponding jump link assembly. When some of the motor heads do not need to operate, the needle bar driving device is driven by the jump motor and the jump link assembly such that the needle bar driving device will deflect and disengage from the needle bar. As a result, the needle bar drive blocks of those machine heads are not loaded, thereby reducing the load on the main shaft. This operation is entirely completed by the jump motor. Due to some uncontrollable factors, there is a probability that a small number of the jump motors may not complete the corresponding action, so that the needle bar drive blocks of the machine heads cannot disengage or cannot completely disengage from the needle bars, and thus cannot achieve the purpose of the design.

SUMMARY

In order to solve the existing problem of conventional embroidery machines when in use, the present disclosure provides an independent presser foot drive mechanism and an embroidery machine using such mechanism that can relatively reduce the load of an embroidery machine, save energy, and is reliable in performance.

The technical solution of the present disclosure for solving the existing problem is an independent presser foot drive mechanism of an embroidery machine, which may include a machine head, a needle bar drive mechanism mounted on the machine head, a needle bar drive block provided on a corresponding needle bar and slidable up and down, and a presser foot drive block. As an improvement, the independent presser foot drive mechanism may further include a presser foot drive motor that independently drives a presser foot, and a presser foot link assembly linking the presser foot drive motor to the presser foot drive block in order to complete driving of the presser foot.

As a further improvement, the presser foot may be provided with an independent presser foot guide rod for positioning the presser foot to slide up and down, the independent presser foot guide rod is located in the machine head, the presser foot drive block is slidably provided on the presser foot guide rod, the presser foot is located at a first guide rod provided on the needle bar drive block, the presser foot drive block is provided with a positioning trough, and the first guide rod is fitted into the positioning trough.

As a further improvement, the presser foot link assembly may include a first link fixed to a motor shaft of the presser foot drive motor, and a second link movably connected with the presser foot drive block, the first and second links being rotatably connected to each other.

As a further improvement, the independent presser foot drive mechanism may further a deflection drive mechanism that drives the needle bar drive block to deflect and disengage from the needle bar. The deflection drive mechanism may include a trigger that cooperates with a corresponding location of the presser foot drive block when the presser foot drive block is ascending to a middle parking position or continuing to ascend to a non-working position, a transmission link assembly that transmits power of the trigger, and a swing arm that cooperates with the transmission link assembly to receive the power so as to drive the needle bar drive block to deflect. The presser foot drive block is provided with a driving part that is in contact with the trigger.

As a further improvement, the trigger may include a trigger bar, and a twist arm connected with the trigger bar, the trigger bar being provided with a bent arm portion that cooperates with the driving part. The transmission link assembly may include a transmission arm rotatable at its centre, one end of the transmission arm cooperates with the twist arm, and another end cooperates with the swing arm.

As a further improvement, cooperating sliding insert and sliding shaft are provided between the twist arm and the transmission arm.

As a further improvement, the swing arm is provided with a bearing that cooperates with the needle bar drive block and drives the needle bar drive block to deflect, the swing arm is provided with a position-restoring resilient body.

As a further improvement, the independent presser foot drive mechanism may further include a jump motor mounted on the machine head of an embroidery machine, the jump motor drives the swing arm to rotate so as to drive the needle bar drive block to deflect and disengage from the needle bar, the jump motor being mounted at one side of an empty space in a housing of the machine head, and the presser foot drive motor being provided at another side in the housing of the machine head.

As a further improvement, the deflection drive mechanism may further include a retaining frame fixed to the machine head, and the transmission link assembly and the trigger are mounted on the retaining frame.

An embroidery machine having at least one machine head mounted thereon may include an independent presser foot drive mechanism, according to any one of the above schemes, mounted on the at least one machine head.

Compared with the prior art, the present disclosure can realize independent driving of the presser foot by providing an independent presser foot drive motor and a presser foot link assembly. The beneficial effect is that the presser foot can independently complete more complicated actions under the driving of the drive motor according to corresponding embroidery processes. At the same time, the independent driving of the presser foot can effectively reduce the load of the main shaft of the embroidery machine, so that the main shaft can run relatively lightly, accuracy of the operation of the main shaft can be improved, or more machine heads can be added.

A deflection drive mechanism is further provided. When some of the machine heads are temporarily not in use, an independent presser foot drive motor drives the presser foot drive block so as to drive the presser foot to a non-working position. A driving part of presser foot drive block cooperates with the trigger of the deflection drive mechanism, and drives the swing arm through the transmission link assembly. Finally, the swing arm cooperates with the needle bar drive block. The swing arm drives the needle bar drive block to deflect and disengage from the needle bar, so that the continuously carrying needle bar drive block is non-loaded This can greatly reduce the load on the main shaft of the embroidery machine.

DETAILED DESCRIPTION OF EMBODIMENTS

Figure 1:
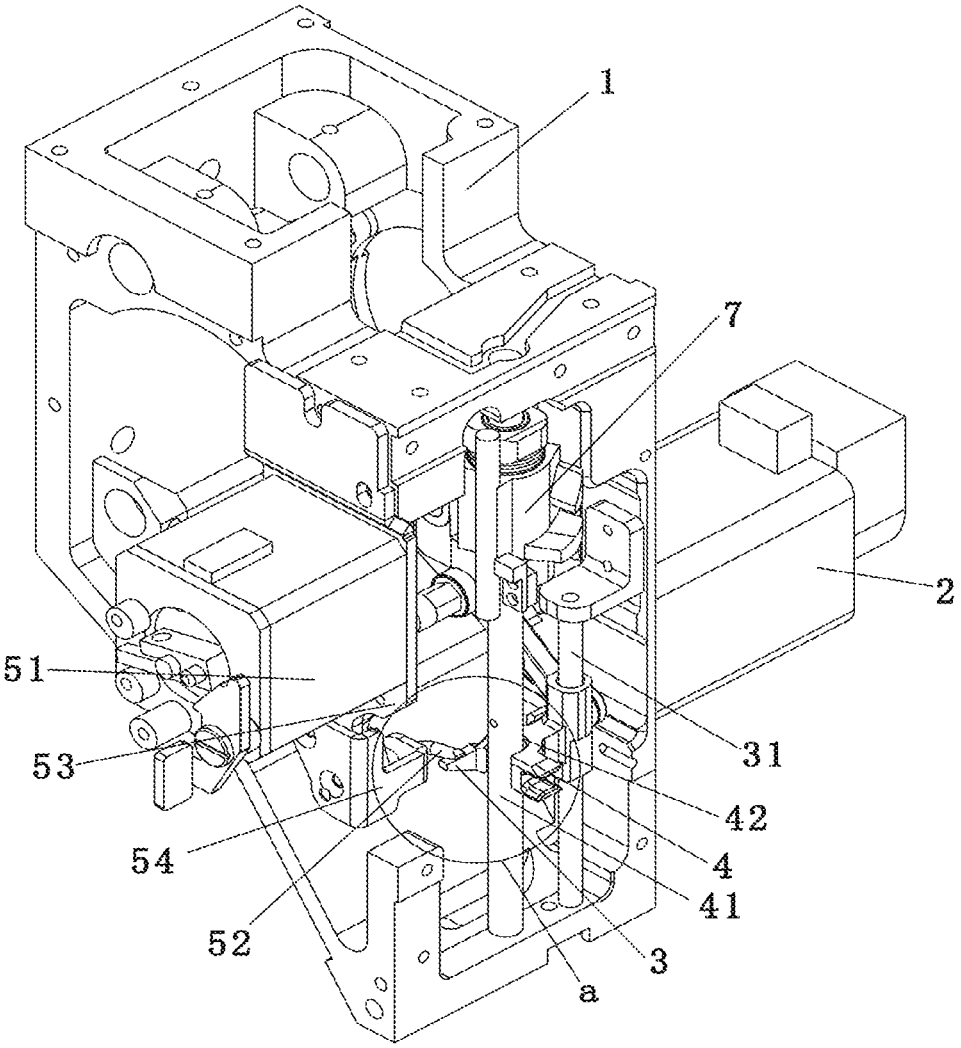
FIG. 1 is a schematic diagram showing the structure of the present disclosure.
Figure 2:
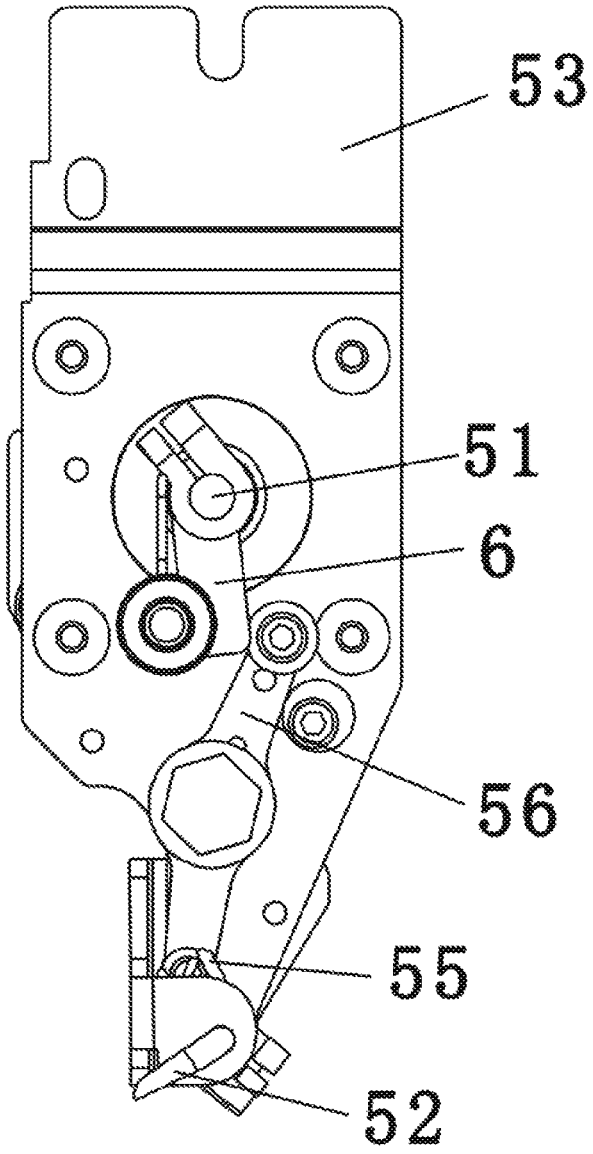
FIG. 2 is a schematic diagram showing the state of a deflection drive mechanism of the present disclosure when the embroidering mechanism is working.
Figure 3:
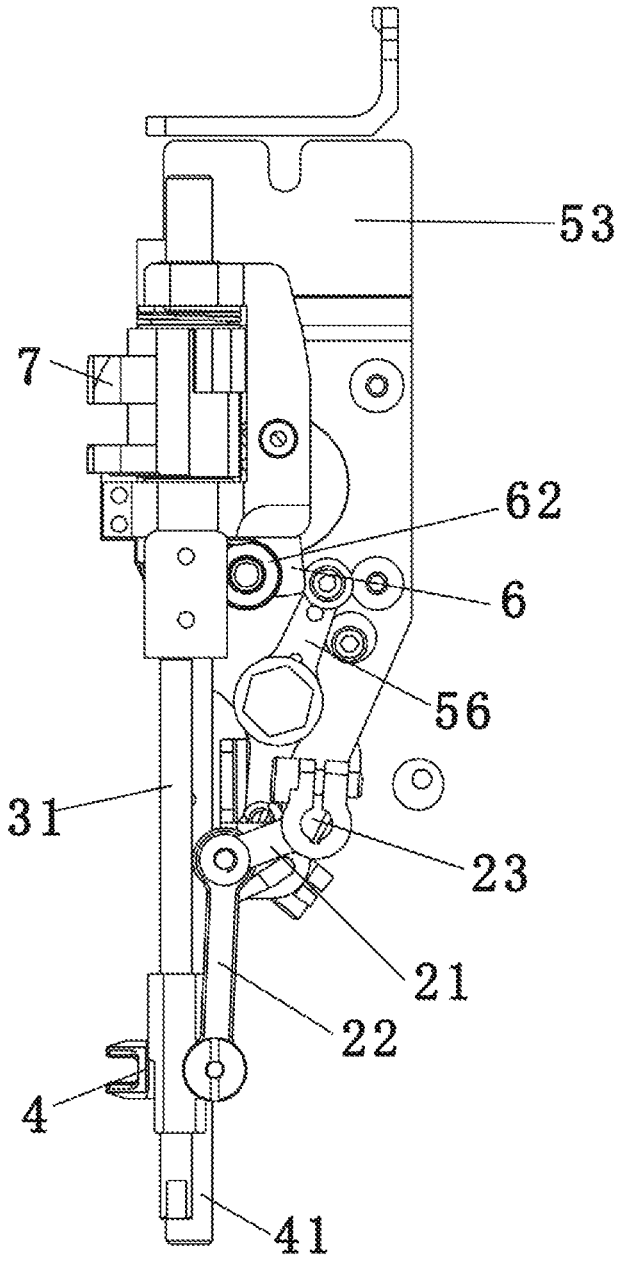
FIG. 3 is a schematic diagram showing the state of a presser foot of the present disclosure when the embroidering mechanism is working.
Figure 4:
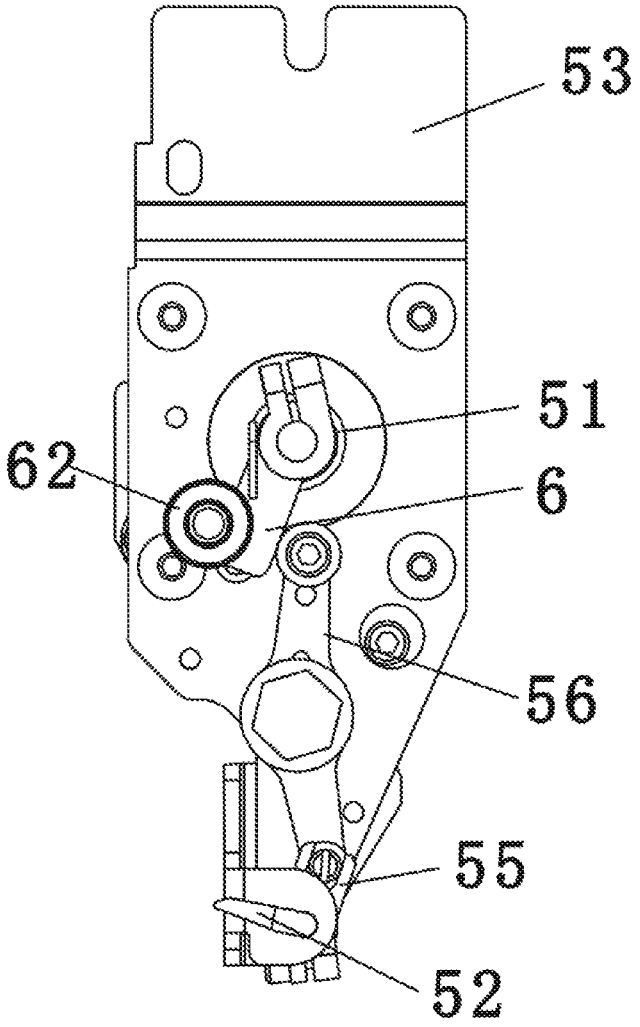
FIG. 4 is a schematic diagram showing the state of a deflection drive mechanism of the present disclosure when the embroidering mechanism is not working.
Figure 5:
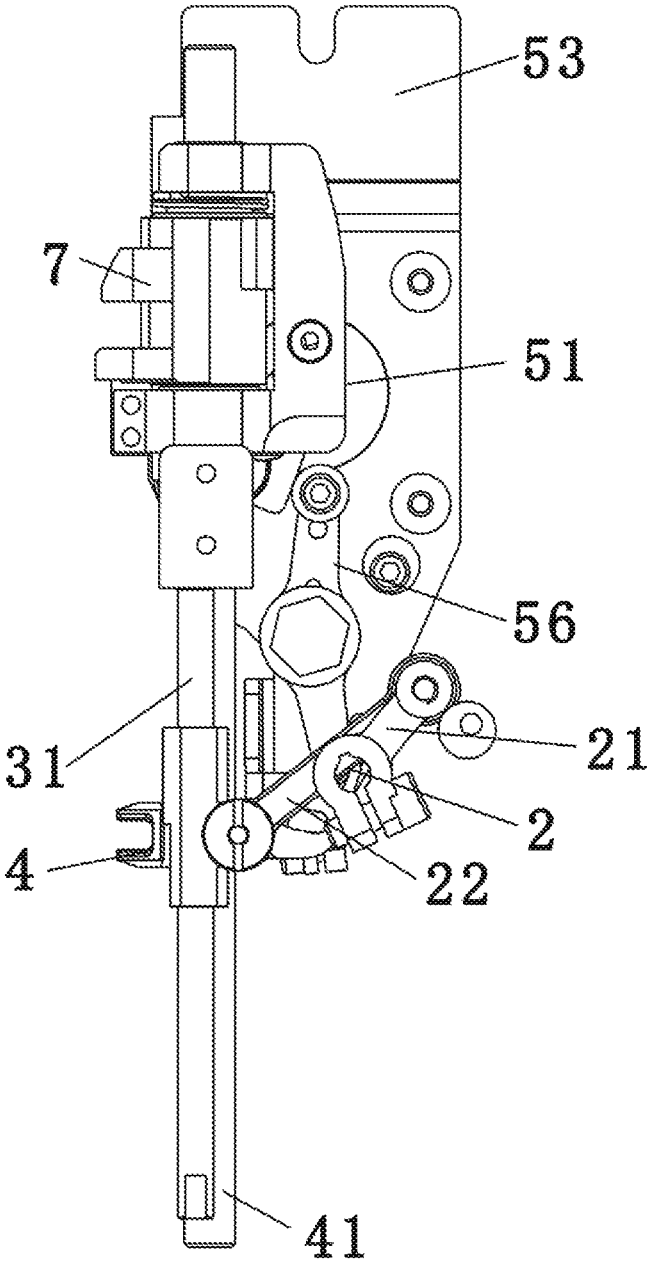
FIG. 5 is a schematic diagram showing the state of a presser foot of the present disclosure when the embroidering mechanism is not working.
Figure 6:
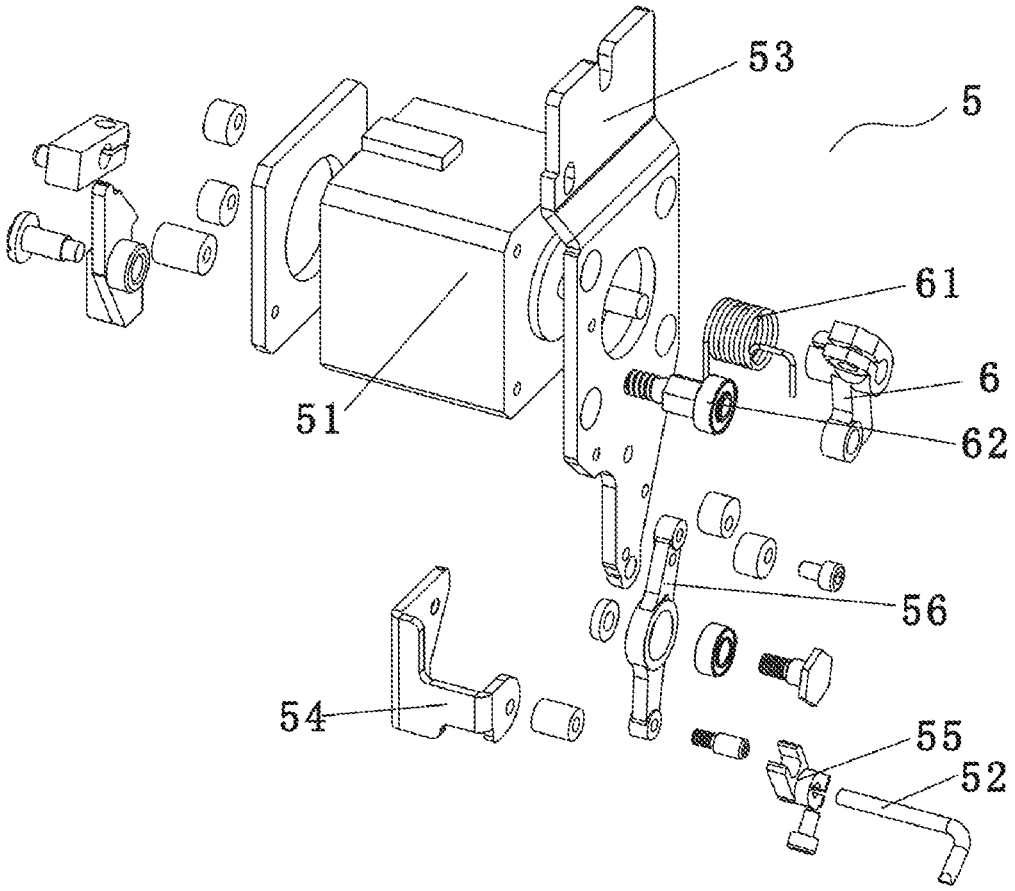
FIG. 6 is an exploded view of the deflection drive mechanism of the present disclosure.
Figure 7:
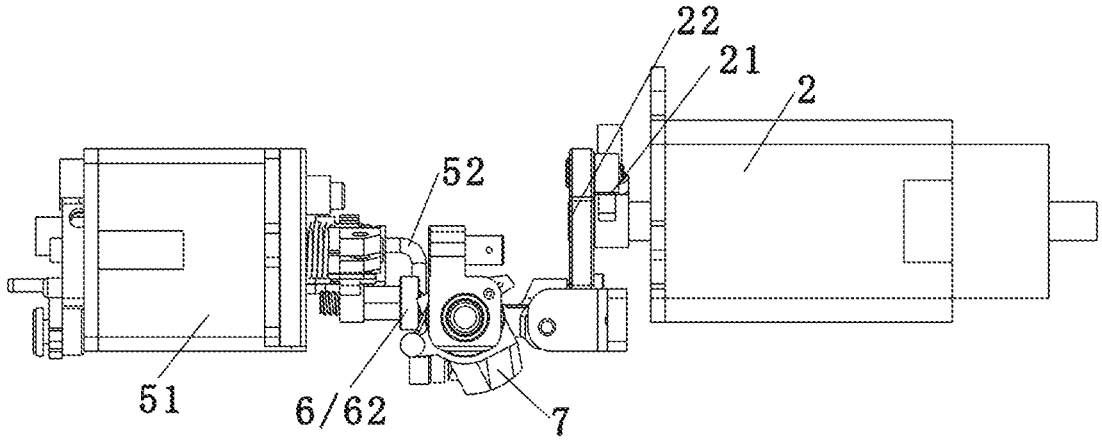
FIG. 7 is a plan view showing the state of driving the needle bar drive block to disengage from the needle bar when not in operation.
Figure 8:
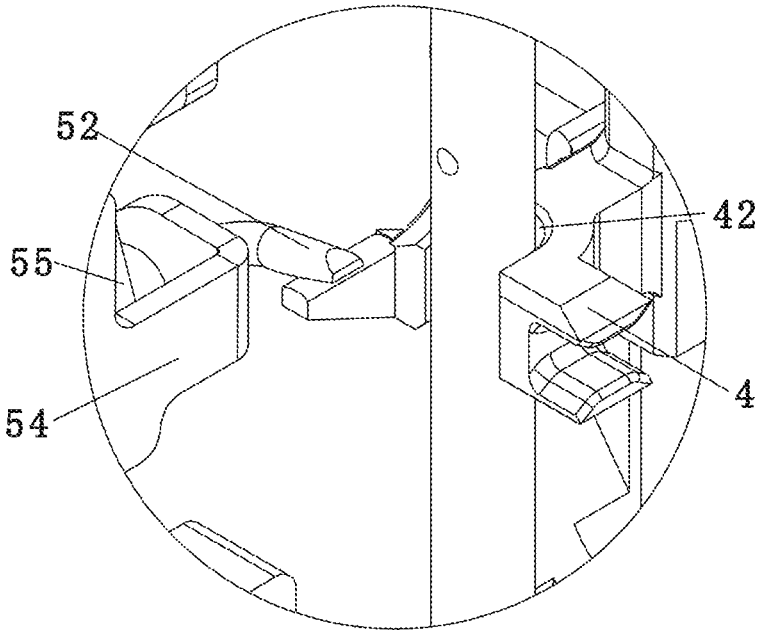
FIG. 8 is an enlarged schematic view at "a" in FIG. 1.

Referring to FIGS. 1-8, the present embodiment may include a machine head 1, a needle bar drive mechanism mounted on the machine head 1, a needle bar drive block 7 provided on a corresponding needle bar and slidable up and down, and a presser foot drive block 4. The independent presser foot drive mechanism may further include a presser foot drive motor 2 that independently drives a presser foot, and a presser foot link assembly linking the presser foot drive motor 2 to the presser foot drive block 4 in order to complete the driving of the presser foot. The presser foot drive motor 2 can be independently fixed, or fixed on the machine head. The needle bar, presser foot bar, presser foot, and needle bar rack are not shown in the drawings. The needle bar, presser foot bar, presser foot, and needle bar rack may adopt the currently known technology in the public. The machine head 1 may be provided with one or more needle bars, and a needle bar rack on which the one or more needle bars are fitted. A presser foot and a presser foot bar connected to the presser foot may be provided behind each needle bar. A currently known corresponding driving device may be adopted to drive the needle bar rack to slide, so that a corresponding needle bar on the needle bar rack can snap-fit to the needle bar drive block 7. At the same time, a corresponding location of a presser foot drive rod behind a corresponding needle bar may be snap-fitted to a corresponding location of the presser foot drive block 4 so as to drive the corresponding needle bar and presser foot to work. The needle bar drive block 7 may be provided with a snap-fit opening for snap-fitting to a corresponding location of a corresponding needle bar. The presser foot drive block 4 may be provided with a snap-fit opening for snap-fitting to a corresponding location of a corresponding presser foot.

In the present embodiment, the presser foot may be provided with an independent presser foot guide rod 31 for positioning the presser foot to slide up and down, and the presser foot guide rod may be located in the machine head 1. The presser foot drive block 4 may be slidably provided on the presser foot guide rod 31. The presser foot may be located at a first guide rod 41 provided on the needle bar drive block 7. The presser foot drive block 4 may be provided with a positioning trough 42. The first guide rod 41 may fit into the positioning trough 42. The positioning trough 42 and the presser foot guide rod 31 may constitute the positioning of the presser foot such that the presser foot drive block 4 can slide up and down according to a preset condition without deflection, and therefore can work normally.

The presser foot link assembly may include a first link 21 that may be fixed to a motor shaft 23 of the presser foot drive motor 2, and a second link 22 that may be movably connected with the presser foot drive block 4. The first and second links 21, 22 may be rotatably connected to each other. The presser foot link assembly may be disposed on one side of the presser foot drive block 4 and on one side close to the presser foot drive motor 2. The independent drive motor 2 and the presser foot link assembly can cooperate with each other in order to complete the ascending and descending of the presser foot as well as actions required for corresponding works. In general, the presser foot drive block 4 can drive the presser foot to three positions, namely a lowest position in a working state, a central temporary parking position, and a highest position in a non-working state.

The independent presser foot drive mechanism may further include a deflection drive mechanism that can drive the needle bar drive block 7 to deflect and disengage from the needle bar. The deflection drive mechanism may include a trigger that cooperates with a corresponding location of the presser foot drive block 4 when the presser foot drive block is ascending to the middle parking position or continuing to ascend to the non-working position, a transmission link assembly that can transmit power of the trigger, and a swing arm 6 that can cooperate with the transmission link assembly to receive the power so as to drive the needle bar drive block 7 to deflect. The presser foot drive block 4 may be provided with a driving part 3 that is in contact with the trigger.

The trigger may include a trigger bar 52 and a twist arm 55 that may be connected with the trigger bar 52. The trigger bar 52 may be provided with a bent arm portion that may cooperate with the driving part 3. The transmission link assembly may include a transmission arm 56 rotatable at its centre. One end of the transmission arm 56 may cooperate with the twist arm 55, and another end may cooperate with the swing arm 6. The driving part 3 may be an extension arm provided on the presser foot drive block 4. The extension arm may be provided with a slanted face that can cooperate with the bent arm portion of the trigger so that the extension arm can smoothly cooperate with the bent arm portion. Cooperating sliding insert and sliding shaft may be provided between the twist arm 55 and the transmission arm 56.

The swing arm 6 may be provided with a bearing 62 that can cooperate with the needle bar drive block 7 so as to drive the needle bar drive block 7 to deflect. The swing arm 6 may be provided with a position-restoring resilient body 61.

The independent presser foot drive mechanism may further include a jump motor 51 mounted on the machine head 1 of the embroidery machine. The jump motor 51 can drive the swing arm 6 to rotate so as to drive the needle bar drive block 7 to deflect and disengage from the needle bar. The jump motor 51 may be mounted at one side of an empty space in a housing of the machine head 1, and the presser foot drive motor 2 may be provided at another side in the housing of the machine head 1. The deflection drive mechanism and the jump motor 51 may constitute a double insurance for disengaging the needle bar drive block 7 of a shutdown machine head from the needle bar. The deflection drive mechanism is a mechanical structure which is more reliable in driving the needle bar drive block 7 of the shutdown machine head to disengage from the needle bar.

The deflection drive mechanism may further include a retaining frame 54 fixed to the machine head 1. The transmission link assembly and the trigger may be mounted on the retaining frame 54. The retaining frame 54 may be provided with a connection board 53 that is connected to a corresponding location at the housing of the machine head. The jump motor 51 may be connected to the connection board 53. The centre of the transmission arm 56 may be connected with the connection board 53 through a rotation shaft.

When the machine head at the upper portion of the embroidery machine is not used, the presser foot drive motor 2 drives the presser foot drive block 4 to ascend through the presser foot link assembly. When the presser foot drive block 4 ascends to the middle parking position or continues to ascend in the non-working position, the extension arm of the driving part 3 of the presser foot drive block 4 touches the bent arm portion to drive the trigger bar 52 to rotate, and then drive the transmission arm 56 to rotate through the cooperation of the sliding insert and the sliding shaft provided at cooperating ends of the twist arm 55 and the transmission arm 56. The other end of the transmission arm 56 drives the swing arm 6 to rotate. The bearing on the swing arm 6 touches the needle bar drive block 7 and drives the needle bar drive block 7 to deflect and disengage from the driven needle bar, so that the needle bar drive block 7 of the machine head that is not in use is not loaded. Of course, the jump motor 51 may independently or synchronously drive the swing arm 6 to rotate. Finally, the bearing on the swing arm 6 touches the needle bar drive block 7 and drives the needle bar drive block 7 to deflect and disengage from the driven needle bar.

When it is necessary to use a temporary shutdown machine head, the presser foot drive motor 2 drives the presser foot drive block 4 to descend through the presser foot link assembly. The extension arm of the driving part 3 of the descending presser foot drive block 4 strikes or disengages from the trigger bar 52, and then drives the transmission arm 56 to rotate in a reverse direction through the cooperation of the sliding insert and the sliding shaft provided at the cooperating ends of the twist arm 55 and the transmission arm 56. The other end of the transmission arm 56 drives the swing arm 6 to rotate in a reverse direction. The swing arm 6 returns to the original position under the influence of the position-restoring resilient body 61 and/or a resilient body on the needle bar drive block 7. The needle bar drive block 7 returns to the cooperating position with the needle bar in order to drive the needle bar to work. Of course, the jump motor 51 can be used to independently or synchronously drive the swing arm 6 to rotate in the reverse direction. Finally, the needle bar drive block 7 returns to the cooperating position with the needle bar so as to drive the needle bar to work.

The present disclosure also discloses an embroidery machine having at least one machine head 1 mounted thereon. The embroidery machine may be provided with an independent presser foot drive mechanism, according to any one of the above schemes, mounted on the at least one machine head.

What is claimed is:

1. An independent presser foot drive mechanism having a machine head, a needle bar drive mechanism mounted on the machine head, a needle bar drive block provided on a corresponding needle bar and slidable up and down, and a presser foot drive block, the independent presser foot drive mechanism comprising:

a presser foot drive motor that independently drives a presser foot;

a presser foot link assembly linking the presser foot drive motor to the presser foot drive block in order to complete driving of the presser foot; and a deflection drive mechanism that drives the needle bar drive block to deflect and disengage from the needle bar, the deflection drive mechanism comprising:

a trigger that cooperates with the presser foot drive block when the presser foot drive block is ascending to a middle parking position or continuing to ascend to a non-working position and thus generates a power;

a transmission link assembly that transmits the power of the trigger; and a swing arm that cooperates with the transmission link assembly to receive the power of the trigger so as to drive the needle bar drive block to deflect, the presser foot drive block being provided with a driving part that is in contact with the trigger.

2. The independent presser foot drive mechanism as claimed in claim 1, wherein the presser foot is provided with an independent presser foot guide rod for positioning the presser foot to slide up and down, the independent presser foot guide rod is located in the machine head, the presser foot drive block is slidably provided on the presser foot guide rod, the presser foot is located at a first guide rod provided on the needle bar drive block, the presser foot drive block is provided with a positioning trough, and the first guide rod is fitted into the positioning trough.

3. The independent presser foot drive mechanism as claimed in claim 1, wherein the presser foot link assembly comprises:

a first link fixed to a motor shaft of the presser foot drive motor; and a second link movably connected with the presser foot drive block, the first and second links being rotatably connected to each other.

4. The independent presser foot drive mechanism as claimed in claim 1, wherein the trigger comprises:

a trigger bar; and a twist arm connected with the trigger bar, the trigger bar being provided with a bent arm portion that cooperates with the driving part, and the transmission link assembly comprises a transmission arm rotatable at its centre, one end of the transmission arm cooperates with the twist arm, and another end cooperates with the swing arm.

5. The independent presser foot drive mechanism as claimed in claim 4, wherein cooperating sliding insert and sliding shaft are provided between the twist arm and the transmission arm.

6. The independent presser foot drive mechanism as claimed in claim 1, wherein the swing arm is provided with a bearing that cooperates with the needle bar drive block and drives the needle bar drive block to deflect, the swing arm is provided with a position-restoring resilient body.

7. The independent presser foot drive mechanism as claimed in claim 4, wherein the swing arm is provided with a bearing that cooperates with the needle bar drive block and drives the needle bar drive block to deflect, the swing arm is provided with a position-restoring resilient body.

8. The independent presser foot drive mechanism as claimed in claim 1, further comprising a jump motor mounted on the machine head of an embroidery machine, the jump motor drives the swing arm to rotate so as to drive the needle bar drive block to deflect and disengage from the needle bar, the jump motor being mounted at one side of an empty space in a housing of the machine head, and the presser foot drive motor being provided at another side in the housing of the machine head.

9. The independent presser foot drive mechanism as claimed in claim 1, wherein the deflection drive mechanism further comprises a retaining frame fixed to the machine head, and the transmission link assembly and the trigger are mounted on the retaining frame.

10. An embroidery machine having at least one machine head mounted thereon, the embroidery machine comprising: an independent presser foot drive mechanism, according to claim 1, mounted on the at least one machine head.

11. An embroidery machine having at least one machine head mounted thereon, the embroidery machine comprising: an independent presser foot drive mechanism, according to claim 2, mounted on the at least one machine head.

12. An embroidery machine having at least one machine head mounted thereon, the embroidery machine comprising: an independent presser foot drive mechanism, according to claim 3, mounted on the at least one machine head.

13. An embroidery machine having at least one machine head mounted thereon, the embroidery machine comprising: an independent presser foot drive mechanism, according to claim 4, mounted on the at least one machine head.

14. An embroidery machine having at least one machine head mounted thereon, the embroidery machine comprising: an independent presser foot drive mechanism, according to claim 5, mounted on the at least one machine head.

15. An embroidery machine having at least one machine head mounted thereon, the embroidery machine comprising: an independent presser foot drive mechanism, according to claim 6, mounted on the at least one machine head.

16. An embroidery machine having at least one machine head mounted thereon, the embroidery machine comprising: an independent presser foot drive mechanism, according to claim 7, mounted on the at least one machine head.

17. An embroidery machine having at least one machine head mounted thereon, the embroidery machine comprising: an independent presser foot drive mechanism, according to claim 8, mounted on the at least one machine head.

* * * * *